United States Patent [19]

Klosterman et al.

[11] Patent Number: 4,787,404

[45] Date of Patent: Nov. 29, 1988

[54] LOW FLOW RATE-LOW PRESSURE ATOMIZER DEVICE

[75] Inventors: Donald H. Klosterman, Morgan Hill; Sofia M. Laskowski, Mountain View, both of Calif.; Scott V. Knee, Minneapolis, Minn.; Shei-Kung Shi, San Jose, Calif.

[73] Assignee: International Business Machines Corporation, Armonk, N.Y.

[21] Appl. No.: 61,840

[22] Filed: Jun. 12, 1987

[51] Int. Cl.[4] ..... B08B 3/02; B08B 5/02

[52] U.S. Cl. ..... 134/198; 134/102; 15/320; 239/398; 239/424; 261/78.1; 261/78.2; 261/DIG. 78

[58] Field of Search ..... 134/102, 198; 15/320, 15/321; 239/398, 423, 424; 261/78.2, 76, DIG. 78, 78.1

[56] References Cited

U.S. PATENT DOCUMENTS

| | | | |
|---|---|---|---|
| 2,713,510 | 7/1955 | Coanda | 261/78.2 X |
| 2,912,064 | 11/1959 | Friedell | 55/464 |
| 3,059,860 | 11/1962 | Hohn | 239/398 X |
| 3,071,540 | 1/1963 | McMalton et al. | 208/163 |
| 3,314,611 | 4/1967 | McCartney et al. | 239/424 |
| 3,430,864 | 3/1969 | Miller et al. | 239/424 |
| 3,510,061 | 5/1970 | Peczeli et al. | 239/424 X |
| 4,162,970 | 7/1979 | Zlokarnik | 261/78.2 X |
| 4,324,365 | 4/1982 | Howarth | 239/424 |
| 4,708,828 | 11/1987 | Plannerer | 261/DIG. 78 |

OTHER PUBLICATIONS

Graves et al., Basic Considerations in the Combustion of Hydrocarbon Fuels with Air, NACA Report 1300, 1957.

*Primary Examiner*—Harvey C. Hornsby
*Assistant Examiner*—Stephen F. Gerrity
*Attorney, Agent, or Firm*—Henry E. Otto, Jr.

[57] ABSTRACT

A low flow rate-low pressure atomizer device is disclosed which is so dimensioned and operated as to accelerate a gas to substantially sonic velocity and cause it to break up a cleaning liquid into small droplets and accelerate these droplets to at least half the velocity of said gas to create shear stress at a surface closely adjacent the exit end of said device, thereby to remove contaminants or the like from said surface.

5 Claims, 1 Drawing Sheet

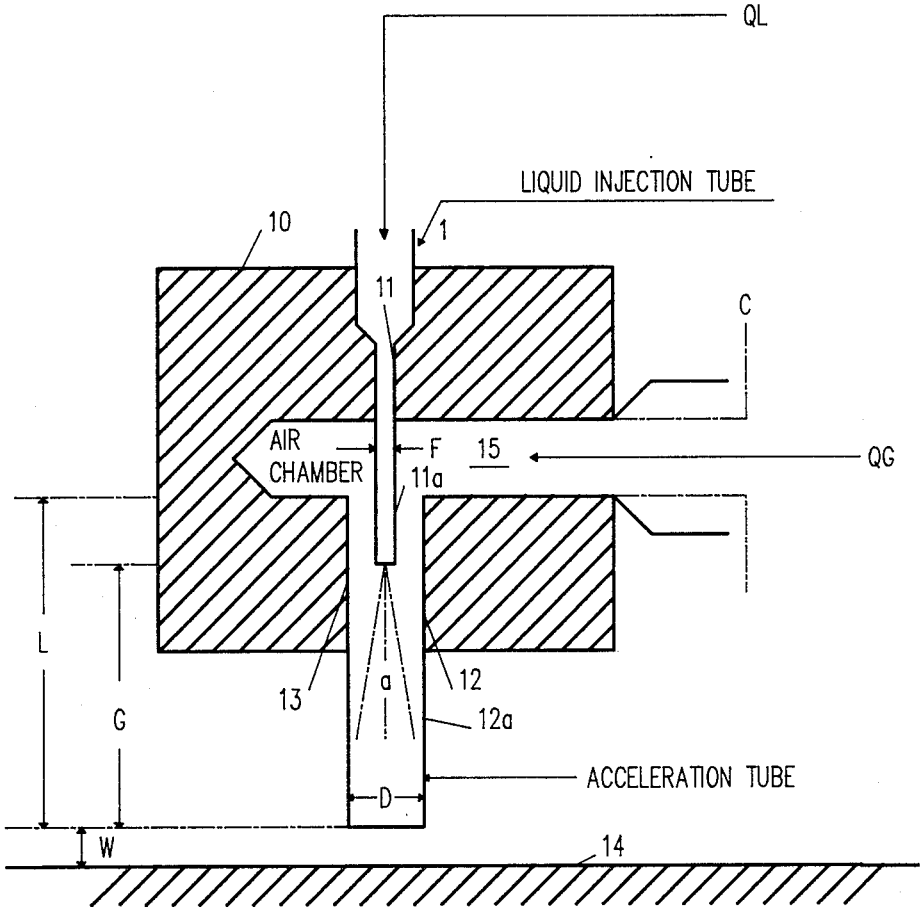
QL
LIQUID INJECTION TUBE
10
1
11
C
AIR
CHAMBER
F
15
QG
11a
L
G
13
a
12
12a
ACCELERATION TUBE
D
W
14

LOW FLOW RATE-LOW PRESSURE ATOMIZER DEVICE

TECHNICAL FIELD

This invention relates to an atomizer device and method, and more particularly to an atomizer device and method whereby high impact (shear) forces are achieved using gas and liquid at low inlet pressures and flow rates that are accelerated to near sonic velocities to effectively clean surfaces.

BACKGROUND OF THE INVENTION

High pressure spray cleaners are frequently used in the electronics and computer industries to obtain ultra clean surfaces. High pressure spray cleaners use high volumes (liters/minute) of liquid at pressures of from 1,000 to 8,000 psi. Use of these large volumes of liquid and high gas pressures results in high operating costs for equipment. Where toxic cleaning liquids or gases are used, there is potential danger to human safety and the environment in disposing of spent liquid and gas or in the event, for example, of rupture of storage tanks containing highly pressurized liquid or gas.

Devices have heretofore been proposed that use gas to atomize liquids to lubricate surfaces or in connection with spectroscopy. For example, U.S. Pat. No. 2,912,064 discloses a device wherein air at a pressure of 5–15 psi is mixed in a venturi throat with an aerosol lubricant of fog-like particles from an aerosol generator for reclassifying them into larger particles immediately prior to deposition with considerable force on a surface to be lubricated.

U.S. Pat. No. 3,430,864 discloses a flume spectrometer including an aspirating burner in which a sample liquid is drawn up from a receptacle through a hypodermic tube by venturi action using a gaseous fuel at a flow rate of approximately 4–15 liters/minute supplied through a restriction surrounding the tube.

U.S. Pat. No. 4,324,365 discloses an atomizer in which liquid is fed to a venturi chamber through a capillary tube. A gas is fed into the chamber and through an annular clearance defined between the outer surface of the tube and surrounding venturi throat. The tube outside diameter is specified as 70–75% of the diameter of the venturi throat to provide the venturi restriction clearance.

These patents and other prior art known to applicant do not disclose an atomizer nozzle device configuration with dimensional relationships suitable for a low flow rate-low pressure atomizer spray cleaner.

SUMMARY OF THE INVENTION

According to the invention, a low flow rate-low pressure atomizer device is provided which is so dimensioned and operated as to accelerate a gas to substantially sonic velocity and cause it to break up a cleaning liquid into small droplets and accelerate these droplets to at least half the velocity of said gas to create shear stress at a surface closely adjacent the exit end of said device, thereby to remove contaminants or the like from said surface.

The flow rate of the liquid is less than 1/1000 that of the gas and less than about 30 milliliters/minute. The pressure of the liquid is preferably between about 20 and 50 psi and that of the gas is preferably between 15 and 100 psi. This low flow rate-low pressure device efficiently cleans surfaces with minimal effluent and is safer and cheaper to operate than high rate-high pressure spray cleaners. Effluent disposition cost and environmental impact are minimized.

BRIEF DESCRIPTION OF THE DRAWING

The single FIGURE is a schematic cross-sectional view of an atomizer device constructed according to the invention.

DESCRIPTION OF PREFERRED EMBODIMENT

As illustrated in the drawing, the atomizer device embodying the invention comprises a housing 10 supporting a liquid injection tube 11, such as a syringe-type needle, and a gas acceleration tube 12. Tube 11 has a portion 11*a* that is coaxially aligned with, and projects with radial clearance into the entry end of, tube 12 to define a venturi throat 13. As illustrated, tube 12 has an exit portion 12*a* that projects exterially of housing 10 into proximity with a work surface 14 that is to be cleaned. Adjacent the entry end of tube 12 is an inlet chamber 15 to which a dry pressurized gas, such as air, is supplied from a suitable source (not shown). Air from this source could be emitted via an impeller (not shown) to circulate and facilitate compaction of the air into a cylindrical configuration. Cleaning liquid is injected into tube 11 from a separate source (also not shown).

According to features of the invention, the ratio QG/QL of the gas to liquid volumetric flow rate should be between 1,000 and 1,000,000, and the ratio of the length L of acceleration tube 12 to its inner diameter D should be greater than 5. This is necessary to obtain desired jet formation, liquid droplet and gas velocities and liquid drop size distribution.

The distance G between the exit end of injection tube 11 and the exit end of acceleration tube 12 is set to minimize liquid impaction on the inner diameter D of the acceleration tube. To achieve this, D/G should be $\geqq 2 \tan a$, where a equals one-half the liquid spray angle of the liquid as it exits tube 11. Further optimization toward eliminating, or at least minimizing, liquid impaction on the inner walls of acceleration tube 12 can be achieved by adjusting the flow parameters QG and QL and the inner diameter F of liquid injection tube 11 with respect to the inner diameter D of the acceleration tube.

W is the distance from the end of acceleration tube 12 to work surface 14. The ratio of W to the inner diameter D of tube 12 should be less than 4 in order to prevent, or at least minimize, jet entrainment and therefore a deceleration due to mixing. Finally, the ratio of the effective inner diameter C of air inlet chamber 15 to the inner diameter D of acceleration tube 12 should be at least 2.5 in order to achieve high (sonic or near sonic) air velocities in the acceleration tube to impart high acceleration to the liquid droplets formed in the manner now to be described.

In operation, cleaning fluid is injected via tube 11 into venturi throat 13, at a pressure of about 20–50 psi and a flow rate of 6–30 ml/min. Concurrently, dry gas is supplied to throat 13 via inlet chamber 15, preferably at a pressure of about 15–100 psi and at a flow rate of less than 5 cu.ft./min. When the air enters acceleration tube 12, it is accelerated substantially to sonic velocity. This high velocity air mixes with the water within tube 12 and breaks up the liquid into small droplets (i.e., atomizes it); these liquid droplets are accelerated by the high velocity air to a velocity at least equal to half that of the air. When these high velocity liquid droplets strike work surface 14, they create shear stress at said surface. The shear stress thus developed will remove contamination or other matter from surface 14 and carry it away from the area of contact.

To maximize the final velocity of the droplets, tube portions 11*a* and 12*a* should be vertically disposed above the work surface 14 so there will be no dropping of the droplet stream due to gravity.

At the time of impact with surface 14, air velocities in excess of 300 meters/sec and of the liquid droplets in excess of 150 meters/sec were achieved using a device operated in the above manner and constructed according to the invention. The cleaning liquid was deionized water at an inlet pressure of 30–35 psi and flow rate of 6–10 ml/min; and the gas was dry air at an inlet pressure of 60 psi and flow rate of 1.65 cu.ft./min. The dimensions of the device were as follows:

QG/QL=5600
L/D=7.4
D/G=0.21 with G=10.8 mm
C/D=2.7
W=about 2 mm
W/D=0.76
a=about 6°

Although in the actual test and application just described, the cleaning liquid used was deionized water, toxic solvents, such as carbon tetrachloride, may be used if desired. In such event, environmental impact is significantly reduced due to low flow rate and hence low volume of effluent required to be removed, and the low pressures of the liquid and gas.

It will be understood that, if preferred, housing 10 may be extended toward work surface 14 such that the outer tube portion 12*a* may be eliminated and tube 12 replaced with merely a bore. As used in the claims, the term "second tube" or "outer tube" should therefore be construed as also covering an extended bore within housing 10. Also, if desired, the apparatus can be used to dry the surface with high velocity dry air after cleaning, by shutting off the supply of liquid to tube 11.

Also, if preferred, the air chamber inlet may be coaxially aligned with tube 12 and the injection tube may enter laterally, so long as the portion 11*a* is coaxially aligned with tube 12.

While the invention has been shown and described with reference to a preferred embodiment thereof, it will be understood by those skilled in the art that the foregoing and other changes in form and detail may be made therein without departing from the spirit, scope and teaching of the invention. Accordingly, the apparatus and method herein disclosed are to be considered merely as illustrative, and the invention is to be limited only as specified in the claims.

We claim:

1. A low flow rate atomizer device for cleaning a surface, comprising:

a first tube through which a cleaning liquid is injectable at a pressure of between 20 and 50 psi;

a second tube coaxially aligned with and surrounding a portion of said first tube with radial clearance and cooperating therewith to define a venturi throat; the length of said second tube being at least five times its inner diameter, and the diameter of the chamber adjacent the inlet end of said throat being at least 2.5 times the inner diameter of said second tube and the distance from the exit end of said second tube to the surface being less than four times the inner diameter of said second tube; and housing means supporting said first and second tubes and providing a chamber adjacent the inlet end of said throat for receiving a pressurized dry gas at a pressure between 15 and 100 psi;

thereby to reduce the volumetric flow rate of the liquid to less than 1/1000 that of the gas and accelerate said gas to substantially sonic velocity and cause it to break up said liquid into small droplets and accelerate said droplets to at least half the velocity of said gas upon exiting said second tube to create shear stress at the surface for removing matter therefrom.

2. An atomizer device according to claim 1, wherein the liquid has a flow rate of less than 30 milliliters/minute, and the gas has a flow rate of less than five cubic feet/minute.

3. An atomizer device according to claim 1, wherein $$D/G \geqq 2 \tan a$$

where

G=distance between the exit ends of said first and second tubes,

D=inside diameter of said second tube, a=one-half the spray angle of the liquid as it exits said first tube, thereby to minimize liquid impaction on the inside of said second tube.

4. An atomizer device for cleaning a surface, said device of the type comprising two tubes having concentric portions with a radial clearance defining a venturi throat, a chamber at the inlet end of said throat for receiving a pressurized gas, the inner of said tubes extending into said throat for injecting a cleaning liquid into the outer of said tubes, which outer tube projects beyond the exit end of said throat, characterized in that (a) the length (L) of said outer tube is at least five times its inner diameter (D), and (b) the diameter (C) of the chamber adjacent the inlet end of said throat is at least 2.5 times the inner diameter (D) of said outer tube, and (c) the distance (G) between the exit ends of the inner and outer tubes is set to minimize liquid impaction on the inner diameter (D) of the outer tube, by having $D/G \geqq 2 \tan a$, where a is one-half the spray angle at which the liquid exits said inner tube, to accelerate the gas to substantially sonic velocity in said outer tube for causing it to break up the liquid into small droplets and accelerate them to at least half the velocity of said gas to create shear stress at said surface to be impacted for removing contaminants therefrom.

5. An atomizer device for cleaning a surface, said device of the type comprising two tubes having concentric portions with a radial clearance defining a venturi throat, a chamber at the inlet end of said throat for receiving a dry gas at a pressure of between 15–100 psi, the inner of said tubes extending into said throat for injecting a cleaning liquid into the outer of said tubes at a pressure of between 20–50 psi and with a volumetric flow rate less than 1/1000 that of the gas, which outer tube projects beyond the exit end of said throat, characterized in that (a) the length (L) of said outer tube is at least five times its inner diameter (D), and (b) the diameter (C) of the chamber adjacent the inlet end of said throat is at least 2.5 times the inner diameter (D) of said outer tube, and (c) the distance (G) between the exit ends of the inner and outer tubes is set to minimize liquid impaction on the inner diameter (D) of the outer tube, by having $D/G \geqq 2 \tan a$, where a is one-half the spray angle at which the liquid exits the inner tube, to accelerate the gas to substantially sonic velocity in said outer tube for causing it to break up the liquid into small droplets and accelerate them to at least half the velocity of said gas to create shear stress at said surface to be impacted for removing contaminants therefrom.

* * * * *